United States Patent [19]

Laxmanan

[11] Patent Number: 5,009,844

[45] Date of Patent: Apr. 23, 1991

[54] PROCESS FOR MANUFACTURING SPHEROIDAL HYPOEUTECTIC ALUMINUM ALLOY

[75] Inventor: Venkatasubramanian Laxmanan, Troy, Mich.

[73] Assignee: General Motors Corporation, Detroit, Mich.

[21] Appl. No.: 444,652

[22] Filed: Dec. 1, 1989

[51] Int. Cl.[5] ..... C22C 1/00; C22C 1/02

[52] U.S. Cl. ..... 420/548; 148/1; 420/590

[58] Field of Search ..... 148/2, 3, 11.5 A, 1; 420/548, 590

[56] References Cited

U.S. PATENT DOCUMENTS

| | | | |
|---|---|---|---|
| 4,106,956 | 8/1978 | Bercovici | 148/11.5 |
| 4,415,374 | 11/1983 | Young et al. | 148/2 |
| 4,865,808 | 9/1989 | Ichikawa et al. | 420/590 |

*Primary Examiner*—R. Dean

*Assistant Examiner*—David W. Schymako

*Attorney, Agent, or Firm*—Douglas D. Fekete

[57] ABSTRACT

A semi-solid metal-forming process for producing an article of a hypoeutectic aluminum-silicon alloy comprises heating a solid billet of the alloy to a temperature intermediate the liquidus temperature and the solidus temperature at a rate not greater than 30° C. per minute, preferably not greater than 20° C. per minute, to form a semi-solid body of the alloy while inhibiting the formation of free silicon particles therein. The semi-solid body comprises a primary spheroidal phase dispersed in a eutectic-derived liquid phase and is conducive to forming at low pressure. In one apsect of this invention, a billet having a quiescently cast microstructure characterized by primary dendrite particles in a eutectic matrix is heated at the slow rate and maintained at the intermediate temperature for a time sufficient to transform the dendrite phase into the desired spheroidal phase.

4 Claims, 2 Drawing Sheets

PROCESS FOR MANUFACTURING SPHEROIDAL HYPOEUTECTIC ALUMINUM ALLOY

BACKGROUND OF THE INVENTION

This invention relates to a process for manufacturing an article of a hypoeutectic aluminum-silicon alloy by shaping a semi-solid body of the alloy comprising spheroidal primary particles dispersed in a liquefied phase and, more particularly, to such semi-solid metal-forming process that comprises heating the alloy to produce the semi-solid body under conditions that inhibit formation of free silicon particles.

A typical microstructure of cast hypoeutectic aluminum-silicon alloy solidified under quiescent conditions comprises primary dendrites dispersed in a eutectic matrix. Alternately, it is known to stir the molten metal during solidification to produce a microstructure comprising degenerate dendrites or spheroids. A billet of the spheroidal microstructure may be advantageously reheated to a temperature intermediate the liquidus temperature and the solidus temperature to partially melt the alloy. At the intermediate temperature, the eutectic matrix is liquefied to form a semi-solid state composed of a mixture of spheroidal particles and liquid phase. The semi-solid metal may be readily formed by a forging-like thixocasting process wherein the semi-solid metal is pressed into a mold using relatively small force.

U.S. Pat. No. 4,106,956, issued to Bercovici in 1978, describes a process for an aluminum alloy that transforms a dendritic microstructure to a spheroidal microstructure without stirring. The process comprises heating the dendritic alloy at a temperature intermediate the solidus temperature and the liquidus temperature to liquefy the matrix and maintaining the partially liquefied alloy at the temperature for a time sufficient to transform the primary phase. U.S. Pat. No. 4,415,374, issued to Young et al in 1983, describes a similar process, but wherein the alloy is worked prior to heating to reduce the time at temperature required for transformation.

It has now been found that rapid heating of hypoeutectic aluminum-silicon alloy to a semi-solid condition produces free silicon particles. In casting processes that include completely melting the alloy, the formation of free silicon by rapid heating has not presented a problem because the free silicon readily dissolves to produce a homogeneous melt. However, dissolution of free silicon in a semi-solid alloy is retarded, so that free silicon particles may be retained in the product alloy. Referring to FIG. 1, there is shown a photomicrograph of a sample of an aluminum alloy that was rapidly induction heated to a semi-solid state and quenched. The alloy contained about 7 weight percent silicon and designated A357 by the Aluminum Association, Inc. The billet was initially cast with electromagnetic stirring during solidification to form a degenerate dendritic microstructure. Following rapid reheating, the microstructure comprises primary silicon particles. The presence of free silicon particles constitutes a hard phase that can reduce machineability and interfere with post-forming heat treatments. Also, it is a common practice to apply an anodization treatment to articles formed of A357 alloy to produce a protective oxide coating. The presence of silicon particles on the surface interferes with anodization and creates a defect in the resulting coating.

It is an object of this invention to provide an improved semi-solid metal-forming process for hypoeutectic aluminum-silicon alloy that inhibits formation of free silicon particles.

It is a more particular object of this invention to provide an improved semi-solid metal-forming process for producing an article of hypoeutectic aluminum-silicon alloy, which comprises heating a solid body of the alloy to produce a semi-solid state at a controlled rate effective to inhibit formation of free silicon particles.

It is an object of one aspect of this invention to provide a semi-solid metal-forming process for manufacturing an article of a hypoeutectic aluminum-silicon alloy, which process comprises heating a cast body having a dendritic microstructure at a rate that inhibits free silicon formation to a temperature effective to liquefy the matrix, while retaining a solid dispersed phase, and thereafter maintaining the alloy at the temperature for a time effective to transform the dendritic phase into a spheroidal phase suitable for thixocasting into a desired shape.

SUMMARY OF THE INVENTION

In accordance with this invention, these and other objects are obtained by a semi-solid metal-forming process that comprises heating a billet of hypoeutectic aluminum-silicon alloy at a rate less than about 30° C. per minute, and preferably less than 20° C., to inhibit formation of free silicon particles. The billet is heated to a temperature between the liquidus temperature and the eutectic temperature, whereupon the alloy forms a slurry comprising primary particles distributed in a liquid phase. In a preferred embodiment of this invention, the billet is a casting having a typical quiescently cast microstructure characterized by a dendritic primary phase and is maintained in the partially liquefied state for a time sufficient to transform the primary dendrites into the desired spheroidal particles. It is found that heating at the slow rate in accordance with this invention avoids the formation of primary silicon particles that might otherwise contaminate the product metal.

DESCRIPTION OF THE DRAWINGS

This invention will be further illustrated by reference to the following figures wherein.

DETAILED DESCRIPTION OF THE INVENTION

Figure 1:
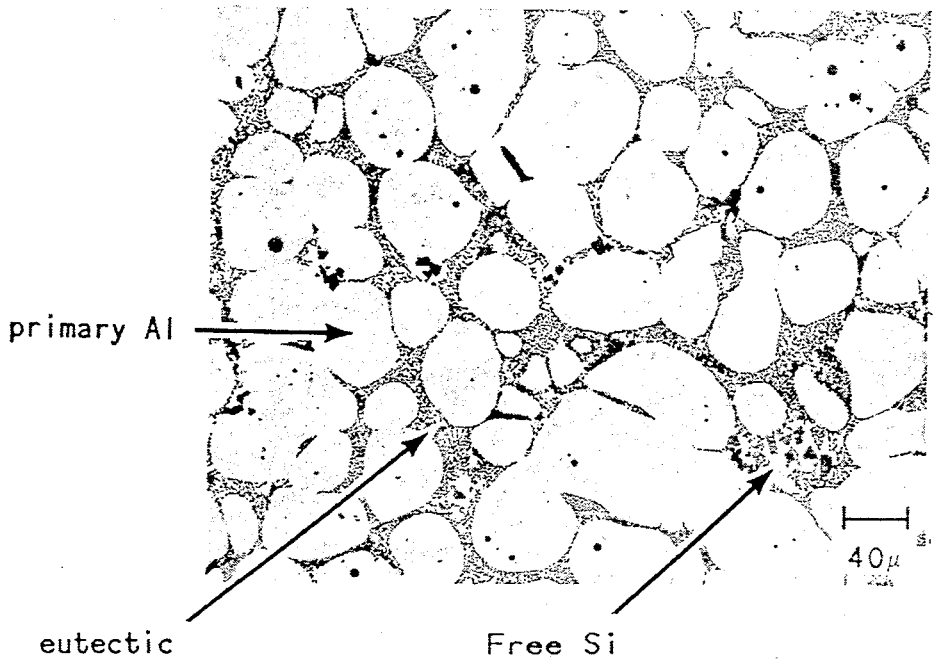
FIG. 1 is a photomicrograph made using an optical microscope and showing a microstructure for aluminum alloy A357 that was rapidly reheated to a semi-solid condition and quenched in accordance with common practice and comprises free silicon particles.
Figure 2:
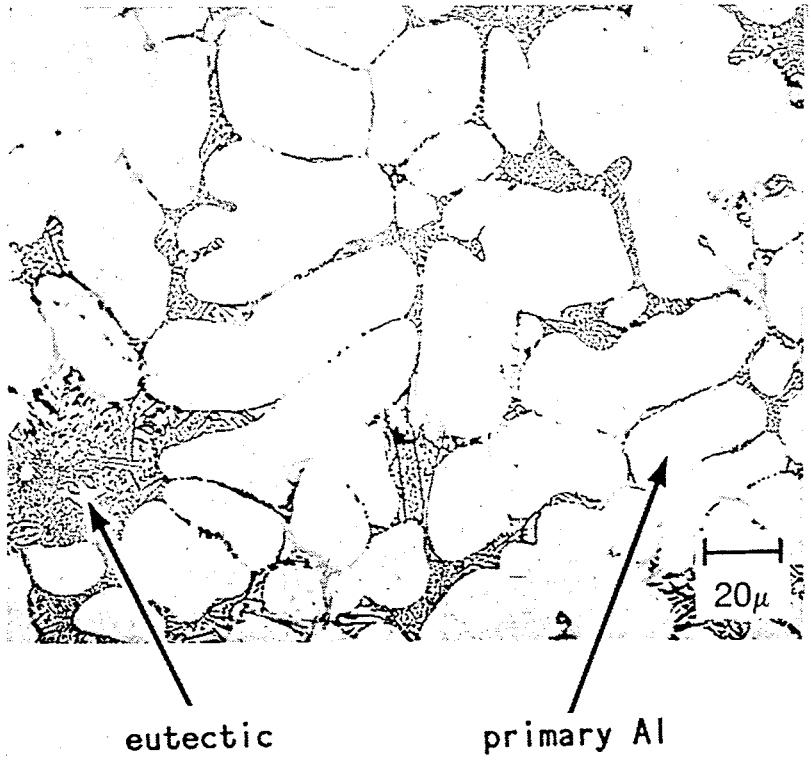
FIG. 2 is a photomicrograph made using an optical microscope and showing an equiaxed microstructure for aluminum alloy A357 master casting that was cast and solidified under quiescent conditions.

In accordance with a preferred embodiment, a master casting of aluminum alloy A357 was cast to produce a microstructure characterized by equiaxed dendritic primary aluminum particles distributed in a eutectic matrix. An ingot of A357 alloy was obtained commercially and melted in a crucible. The composition of the alloy was, by weight, between 6.5 and 7.5 percent silicon, less than 0.5 percent magnesium, less than 0.5 percent copper, less than 0.5 percent zinc and the balance aluminum. The melt was cast into a graphite mold to form a cylindrical bar about 2.54 centimeters in diameter and about 30 centimeters long. The metal was solidified under quiescent conditions, that is, without stirring or other agitation of the type that might produce a degenerate dendrite microstructure. The resulting as-cast microstructure was characterized by equiaxed dendrites dispersed in a eutectic matrix and is shown in FIG. 2.

For processing, the master casting was sectioned and machined to produce billets that were about 2 centimeters in diameter and about 1.27 centimeters in height.

Figure 3:
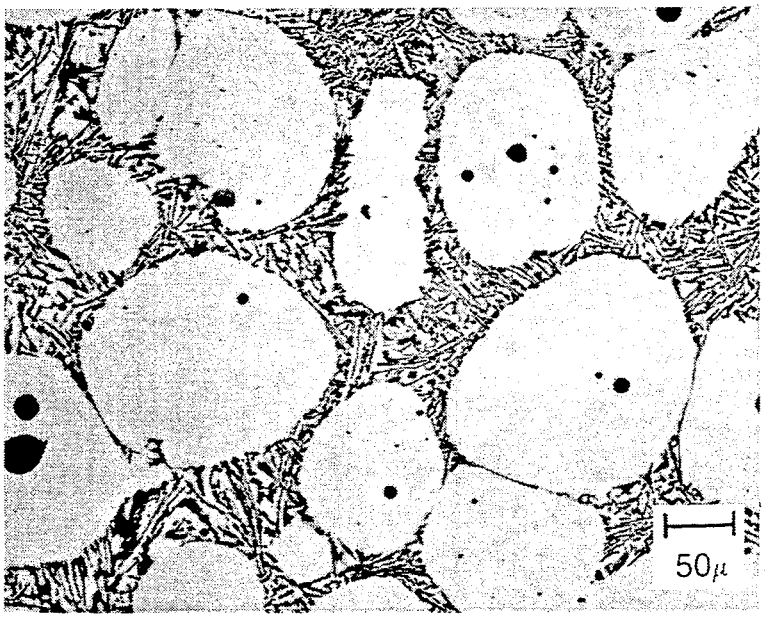
FIG. 3 is a photomicrograph made using an optical microscope and showing a microstructure for the alloy in FIG. 2 following gradual heating to a semi-solid state in accordance with this invention and essentially free of free silicon particles.

In accordance with this invention, a billet was reheated in an electric resistance furnace at a rate of 19° C. per minute to a temperature of 586° C. and held at the temperature for 120 minutes. At the temperature, the eutectic matrix melted to produce a semi-solid body. It is estimated that the liquid fraction was about 30 volume percent. Also, the as-cast dendrites were transformed to a spheroidal morphology. Following heating, the billet was withdrawn from the furnace and quenched in cold water. The resulting microstructure is shown in FIG. 3 and comprises a spheroidal primary phase dispersed in a eutectic matrix and is substantially devoid of free silicon particles. For purposes of comparison, billets of the master casting were reheated to a semi-solid condition at rates of 41° C. and higher per minute and quenched, whereupon the microstructures were observed to include free silicon particles.

The product billet having the spheroidal microstructure was deemed well suited for reheating to a semi-solid state and forming by thixocasting or other low-pressure forming operation. This invention is also applicable to inhibit silicon particle formation during the reheating of spheroidal alloy to semi-solid state. Accordingly, the spheroidal billet is preferably reheated at a rate less than 20° C. per minute. The reheating step may be eliminated by forming the semi-solid billet after transformation, without the intermediate quench. Thus, the dendritic alloy may be heated to the partially melted condition, held to transform to the spheroidal morphology, then formed and quenched.

The process of this invention is generally applicable to hypoeutectic aluminum-silicon alloys characterized by primary aluminum particles dispersed in a eutectic matrix. This invention is particularly suited for alloys containing between about 5 and 12 weight percent silicon. Less than about 5 percent silicon results in a soft alloy having insufficient eutectic to produce a semi-solid body conducive to low pressure forming operations. The binary eutectic composition consists of about 12 weight percent silicon. Preferred alloys comprise between about 6 and 8 weight percent silicon.

In general, such hypoeutectic alloys initiate melting at a temperature, referred to as the solidus temperature, that is near the melting point of the aluminum-silicon binary eutectic melting point of 577° C. For the described alloy, the solidus temperature was estimated to be about 576° C., the difference being attributed to the presence of minor quantities of other metals that depress the melting point. The liquidus temperature for such alloys varies upon the specific composition. This invention contemplates heating the alloy to a maximum temperature between the liquidus and solidus temperatures, whereat the alloy exists as a slurry of liquid and solid phases. The proportion of liquid in the slurry depends upon the particular temperature to which the alloy is heated, as well as the specific composition. For thixocasting and similar forming processes carried out using a semi-solid body, it is desired to control the maximum temperature so that the billet retains its shape. For the preferred A357 alloy, a liquid fraction between 30 and 40 percent by volume is obtained by heating between 580° C. and 590° C. and produces a self-sustaining body that is conducive for forming at low pressure.

While not limited to any particular theory, it is believed that differential thermal expansion between the dispersed phase and the matrix during heating creates stresses within the microstructure. During rapid heating, these stresses become concentrated at localized sites, whereupon free silicon coalesces from the eutectic in an effort to relieve the localized stresses. It is found that free silicon particles are produced as a result of rapid heating even though the uppermost temperature does not exceed the solidus temperature so as to initiate melting of the alloy. In accordance with this invention, heating at a slower rate is believed to allow the stress to become distributed within the microstructure and thereby avoid the concentration of stress that would drive the silicon to separate from the eutectic. Heating rates not greater than about 30° C. per minute are believed to be generally effective to inhibit free silicon formation. It is preferred to heat at a rate not greater than about 20° C. per minute. These values represent the maximum rate at which the temperature of the alloy rises over the temperature range prior to initiating liquid phase formation. As the temperature approaches the solidus temperature, the heating rate naturally decreases. Thus, for the described A357 alloy, a thermal arrest is observed at between about 574° C. and 576° C., corresponding to the initiation of the liquid phase.

While this invention has been disclosed in terms of a specific embodiment thereof, it will be appreciated that other compositions could be readily adapted by one skilled in the art. Accordingly, the scope of my invention is to be considered limited only by the following claims.

The embodiments of the invention in which an exclusive property or privilege is claimed are defined as follows:

1. A semi-solid metal-forming process for producing an article of a hypoeutectic aluminum-silicon alloy comprising between about 5 and 12 weight percent silicon, said process comprising heating a body of hypoeutectic aluminum-silicon alloy to a temperature between the liquidus temperature and the solidus temperature to initiate partial melting of the alloy and thereby to form a semi-solid body composed of a spheroidal phase dispersed in a liquid phase, said heating being carried out at a rate not greater than 30° C. per minute and effective to inhibit formation of free silicon particles within said alloy.

2. A process for forming an article of hypoeutectic aluminum-silicon alloy comprising between about 5 and 12 weight percent silicon, said process comprising heating a quiescently cast billet characterized by a microstructure comprising a dendritic phase dispersed in a eutectic matrix at a rate not to exceed 20° C. per minute and effective to inhibit formation of free silicon particles within the alloy, said heating being carried out to a temperature between the liquidus temperature and the solidus temperature to initiate partial melting of said alloy, and maintaining the billet at said temperature for a time sufficient to transform said dendritic phase into a spheroidal phase.

3. A process for forming an article of hypoeutectic aluminum-silicon alloy comprising between about 6 and 8 weight percent silicon, said process comprising heating a quiescently cast billet characterized by a microstructure comprising a dendritic phase dispersed in a eutectic matrix at a rate not to exceed 20° C. per minute and effective to inhibit formation of free silicon particles within the alloy, said heating being carried out to a temperature between the liquidus temperature and the solidus temperature to initiate partial melting of said alloy, and maintaining the billet at said temperature for a time sufficient to transform said dendritic phase into a spheroidal phase.

4. The process of claim 3 comprising the further steps of forming the semi-solid body into a desired configuration and quenching the formed body to produce the article.

* * * * *